US011192017B2

(12) United States Patent
Mueller

(10) Patent No.: US 11,192,017 B2
(45) Date of Patent: Dec. 7, 2021

(54) MOUTHGUARD WITH LUNG EXERCISER

(71) Applicant: James F. Mueller, Overland Park, KS (US)

(72) Inventor: James F. Mueller, Overland Park, KS (US)

( * ) Notice: Subject to any disclaimer, the term of this patent is extended or adjusted under 35 U.S.C. 154(b) by 510 days.

(21) Appl. No.: 16/234,774

(22) Filed: Dec. 28, 2018

(65) Prior Publication Data

US 2019/0201774 A1 Jul. 4, 2019

Related U.S. Application Data

(60) Provisional application No. 62/611,625, filed on Dec. 29, 2017, provisional application No. 62/676,934, filed on May 26, 2018, provisional application No. 62/611,408, filed on Dec. 28, 2017.

(51) Int. Cl.

| | |
|---|---|
| ***A63B 71/08*** | (2006.01) |
| ***A63B 23/18*** | (2006.01) |
| ***A63B 1/00*** | (2006.01) |

(52) U.S. Cl.

CPC ..... *A63B 71/085* (2013.01); *A63B 1/00* (2013.01); *A63B 23/18* (2013.01); *A63B 2071/086* (2013.01)

(58) Field of Classification Search

CPC ..... A63B 23/18; A63B 23/032; A63B 71/085; A63B 2071/086; A63B 1/00; A61M 16/0493; A61M 16/049; A61M 16/0488; A61M 16/208; A61M 15/002; A61M 15/08; A61M 2016/003; A61M 2016/0027; A61F 5/56

See application file for complete search history.

(56) References Cited

U.S. PATENT DOCUMENTS

| | | | |
|---|---|---|---|
| 4,143,872 | A | 3/1979 | Havstad et al. |
| 4,634,117 | A | 1/1987 | Kramer |
| 4,973,047 | A | 11/1990 | Norell |
| 8,177,689 | B2 | 5/2012 | Rutten |
| 10,080,511 | B1 | 9/2018 | Boutros |
| 10,252,021 | B2 | 4/2019 | Boutros |
| 10,463,912 | B2 | 11/2019 | Boutros |
| 2012/0000472 | A1 | 1/2012 | Martucci |
| 2015/0231443 | A1 | 8/2015 | Halliday |

*Primary Examiner* — Ophelia A Hawthorne
(74) *Attorney, Agent, or Firm* — Christopher J. Scott

(57) ABSTRACT

An athletic mouthguard with lung exercising variable, two-way airflow-restricting valve is disclosed. The mouthguard has a mouthpiece with a lower tooth bed and an upper tooth bed overlying the lower. Outer and an inner sidewall connects the beds. A channel passes between the lower and upper beds with a first end open within the inner sidewall and a second end open within the outer sidewall. Certain embodiments include a channel wall which separates the channel into multiple channels. A manifold in fluid communication with the channel terminates to a centralized aperture with a valve seat. A rotatable valve member in the valve seat has an aperture therethrough.

20 Claims, 17 Drawing Sheets

MOUTHGUARD WITH LUNG EXERCISER

CROSS-REFERENCE TO RELATED APPLICATIONS

This application claims the benefit of U.S. Provisional Patent Application No. 62/611,408 filed Dec. 28, 2017, U.S. Provisional Patent Application No. 62/611,625 filed Dec. 29, 2017 and U.S. Provisional Patent Application No. 62/676,934 filed May 26, 2018 which applications are hereby incorporated by reference.

BACKGROUND OF THE INVENTION

Field of the Invention

This invention generally relates to mouth pieces, and more particularly to athletic mouthguards with lug exercisers incorporated therein.

Description of Related Art

Unrestricted air flow through the lip protector and mouthguard into and out of the lungs is employed during competition and currently available in marketplace. However, there is a need to both protect the mouth, lips, teeth and jaw by way of the mouthguard, while also training the lungs, improving lung efficiency and muscles via adjustable airflow restriction into and out of lungs through both inspiration and expiration of lungs. Current mouthguard systems are not designed to allow adjustable restriction of airflow to exercise the lungs. Currently available lung trainers, masks and lung exercisers are designed exclusively for lung training and are not designed to be protective of the mouth, nor will they fit under an athletic helmet facemask, with none affording mouth protection, comfort fit, two-way inspiration and expiration resistance lung training with ergo-dynamic fit, feel and low profile to fit under (behind) athletic protective facemasks. Thus, the combination mouthguard and lung exerciser device of the present invention meets a clear and present need that is unmet in the marketplace. Athletes (or non-athlete users) can employ both mouthguard protection and lung training utility in one combined device, allowing use during practices or other training events to help condition and improve lung function while protecting mouth, teeth, etc. while wearing under (behind) an athletic helmet facemask, or not depending upon user need.

It is understood there are prior art devices that restrict airflow into the lungs in order to activate respiratory muscle. There are also many mouthguard devices available for protecting teeth, mouth, gums and soft oral tissue from impact and injury. Mouthguards reduce the chance of injuries resulting from impacts of collisions during athletic competition and sporting events. Various types of mouthguards include: standard-stock-type fit, custom-fit molded to individual's teeth, and non-custom fit for general use.

There are also many lung conditioners, or respiratory exercisers available which improve overall lung efficiency, strength and stamina by restricting airflow into the lungs through the mouth and nose in order to increase inspiratory and/or expiratory muscle strength and endurance. Various respiratory training device types are available, some medical specific, some sport specific. Some lung trainer devices only provide resistance in airflow upon inspiration while some only offer resistance upon exhalation. Others provide both inspiratory and expiratory resistance.

The restriction of airflow to the lungs through the mouth and nose during exercise enables the body to adjust to a higher level of efficiency requiring less oxygen by improving lung muscles strength and conditioning lungs to adjust to a higher level of functioning. This increased lung efficiency, in part, is a function of improved inspiratory and or expiratory muscle strength. Short of training at high altitudes, it is difficult to improve lung function and strengthen respiratory muscles without restricted airflow during normal breathing or during exercise.

SUMMARY OF THE INVENTION

The invention generally involves athletic mouthguards with lung exercisers. One version of the mouthguard has a lower arcuate tooth bed with left and right molar sections an upper arcuate tooth bed with left and right molar sections, where the upper bed is spaced apart from and overlies the lower bed. An outer and inner sidewall connects the lower and upper beds and define a channel between them. The channel is coextensive with the beds and has a plurality of apertures through the sidewalls which are open to the channel. The apertures are located adjacent the left and right molar sections of the beds. An aperture through the outer sidewall opens to the channel. A valve body has an airflow port in fluid communication with the aperture of the outer sidewall. An annular valve seat surrounds the airflow port. A rotatable valve member, seated in the valve seat has an aperture therethrough.

Another version of the mouthguard has a mouthpiece with a lower tooth bed and an upper tooth bed overlying the lower. Outer and an inner sidewall connects the beds. A channel passes between the lower and upper beds with a first end open within the inner sidewall and a second end open within the outer sidewall. A manifold in fluid communication with the channel terminates to a centralized aperture with a valve seat. A rotatable valve member in the valve seat has an aperture therethrough.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include an exemplary embodiment to the invention, which may be embodied in various forms. It is to be understood that in some instances various aspects of the invention may be shown exaggerated or enlarged to facilitate an understanding of the invention.

DETAILED DESCRIPTION OF PREFERRED EMBODIMENTS

Detailed descriptions of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Terms are used here in a generic and descriptive sense only and not for purposes of limitation. Unless expressly defined, such terms are intended to be given their broad, ordinary and customary meaning not inconsistent with that used in the relevant industry. As used here, the article "a" is intended to include one or more items. Where only one item is intended, the term "one", "single", or similar language is used.

The mouthguard device of the present invention protects lips (when optional lip shield is used), teeth, gums, soft tissue while providing a lung exerciser used for breathing exercises through airflow resistance to both inspiration and expiration of the user's lungs thus improving lung efficiency and inspiratory and expiratory muscle strength.

The mouthguard device can be configured and/or adjusted to afford resistance free breathing and multiple (up to infinite) resistance to breathing levels which offer varying levels of airflow to and from the user's lungs, depending upon the level of conditioning and desired needs of the user. As with other resistance training exercises, inhalation and exhalation resistance training can improve lung performance, respiratory efficiency and overall athletic performance. In certain embodiments, the present invention provides no airflow resistance, or multiple airflow resistances for both inspiratory and expiratory respiration lung conditioning.

Figure 1:
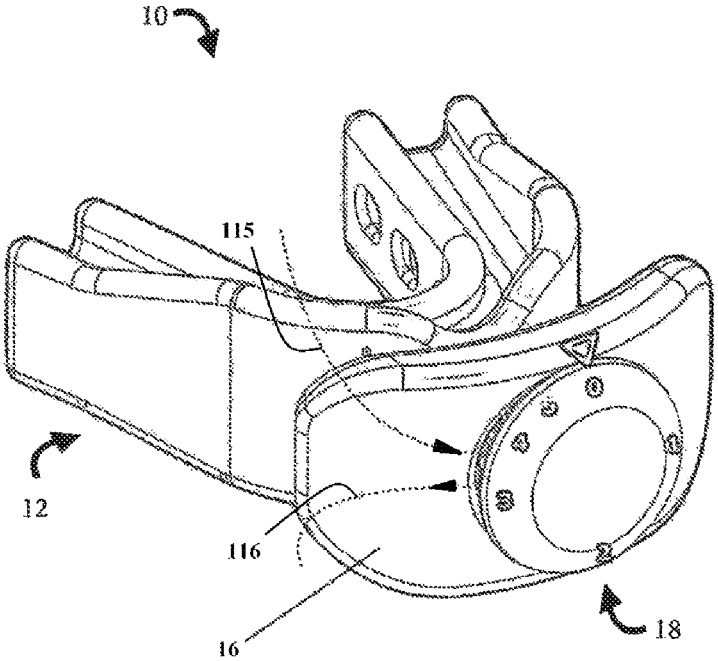
FIG. 1 shows a first preferred embodiment of an athletic mouthguard with variable airflow-restricting valve according to the invention.
Figure 2:
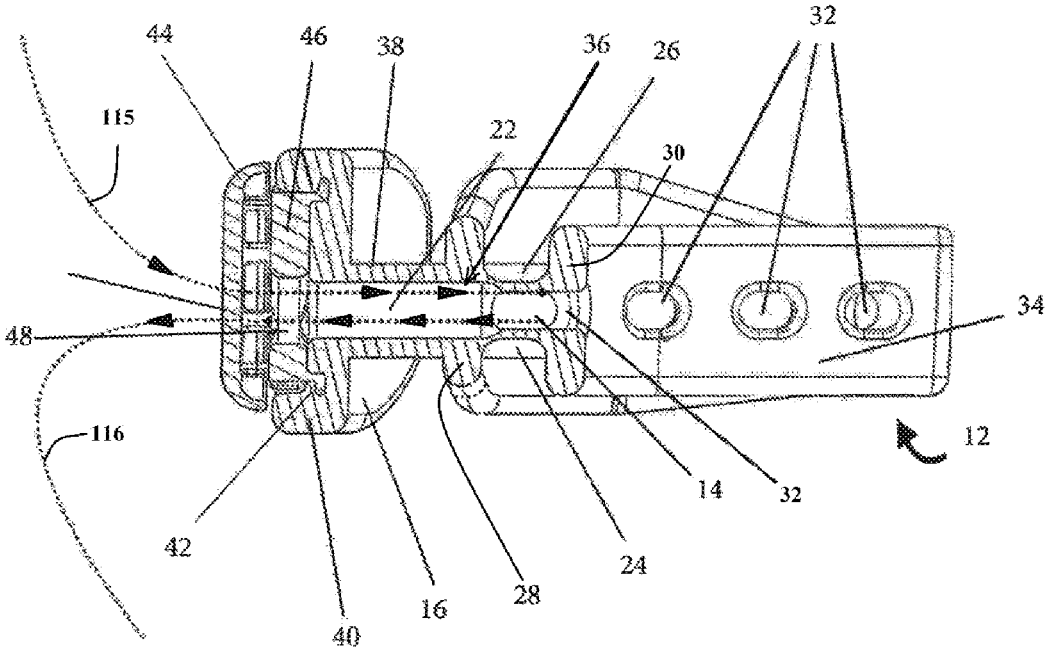
FIG. 2 is a side elevation view of the mouthguard of FIG. 1 in partial cross-section.
Figure 3:
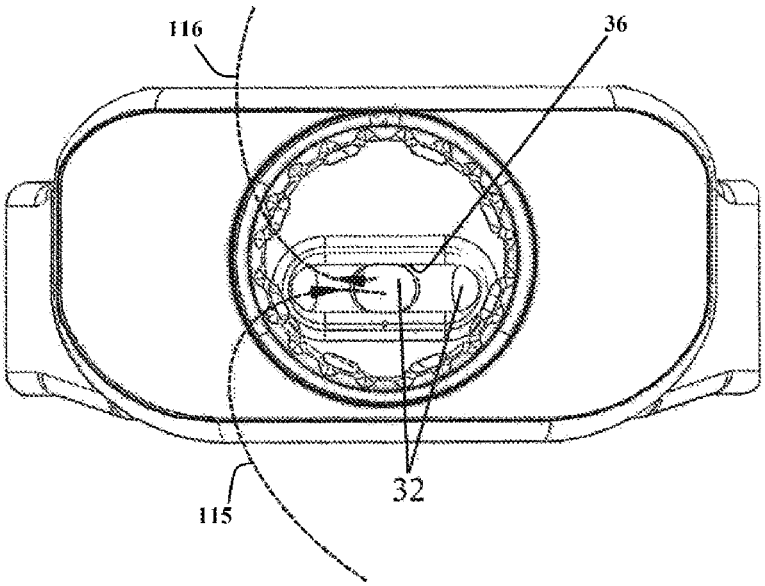
FIG. 3 is a front elevation view of the mouthguard of FIG. 1.
Figure 4:
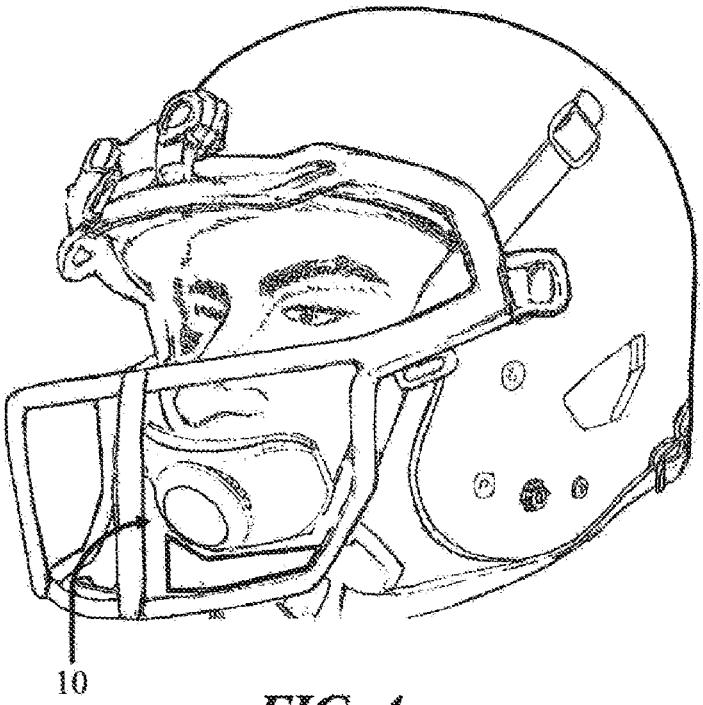
FIG. 4 depicts an athlete using the mouthguard of FIG. 1 while wearing an athletic helmet with facemask.
Figure 5:
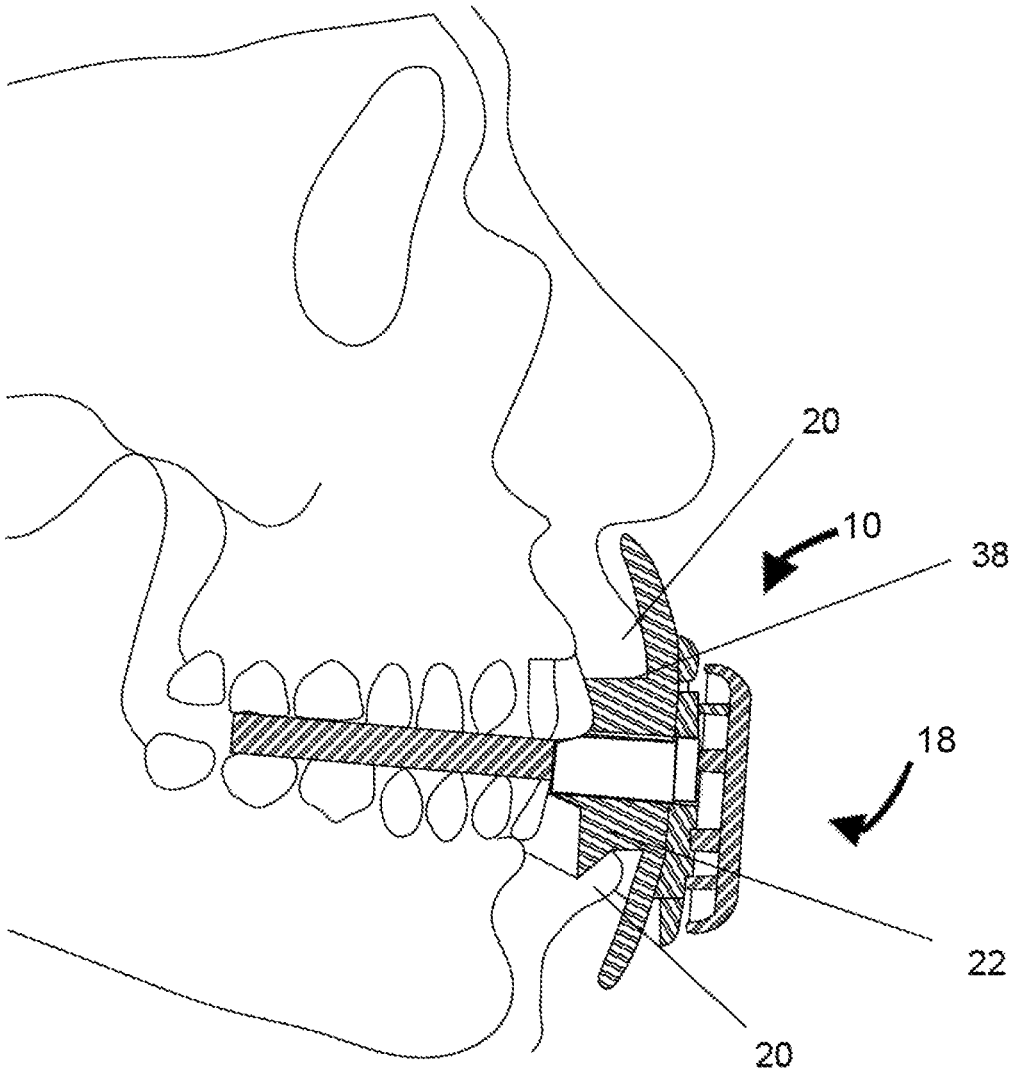
FIG. 5 is a cross-sectional depiction of how the mouthguard of FIG. 1 may be used.
Figure 6:
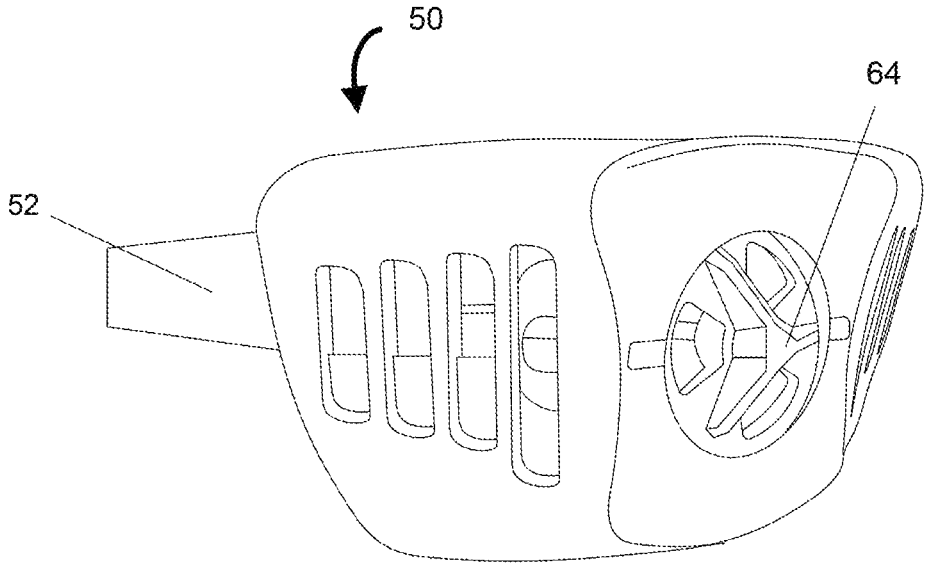
FIGS. 6-9 show a second preferred embodiment of an athletic mouthguard with variable airflow-restricting valve according to the invention.
Figure 7:
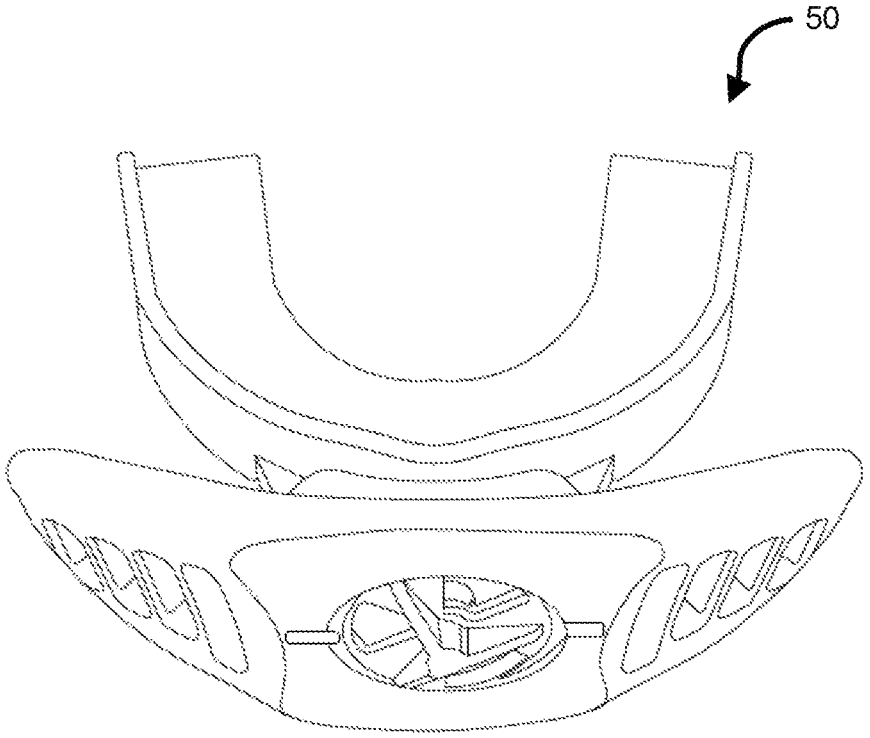
Figure 8:
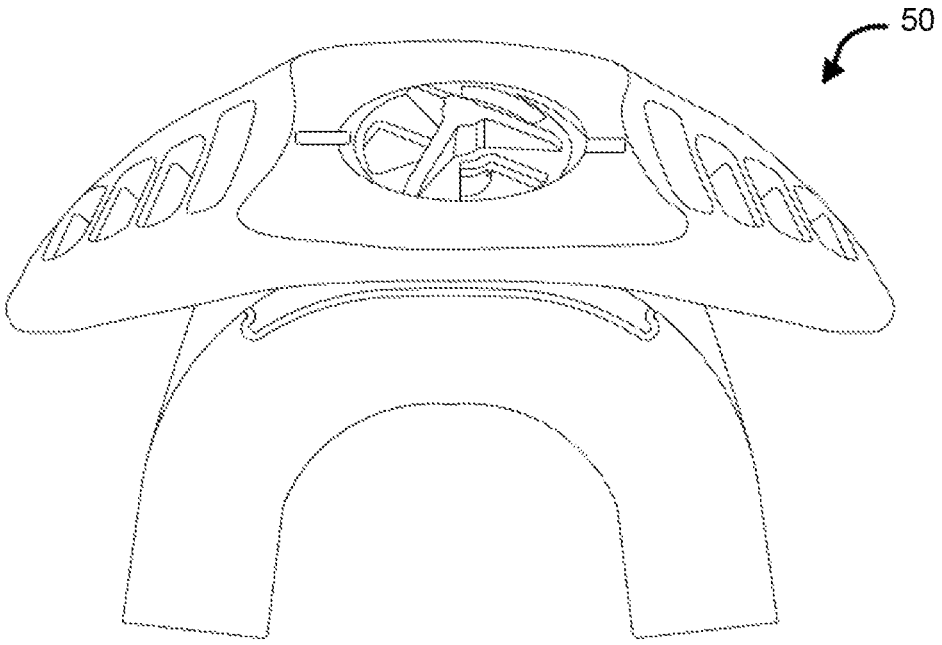

FIGS. 1-3 show a first preferred embodiment of an athletic mouthguard with compact lung exerciser variable airflow-restricting valve 10 according to the invention which can be used by athletes wearing helmets with facemasks as shown in FIG. 4. Mouthguard 10 generally comprises mouthpiece 12 with integrated airflow channel 14 (FIG. 2), and lip protector 16 with integrated adjustable airflow-restricting valve 18 connected to airflow channel 14. Athletes can hold mouthguard 10 in their mouths as shown in FIG. 5 with their lips 20 pressed against the walls of airflow port 22, allowing themselves to only breath through integrated airflow channel 14 and adjustable airflow-restricting valve 18. It is contemplated, in certain versions of this preferred embodiment, lip protector 16 would not be included. In these versions, adjustable airflow-restricting valve 18 would generally maintain the same configuration, but without lip protector 16 extending outwardly from valve 18 as is shown in the drawings.

FIG. 2 shows airflow channel 14 is integrated into mouthpiece 12 between its lower (24) and upper (26) tooth beds and is defined by outer sidewall 28 and inner sidewall 30. A plurality of apertures 32 within inner sidewall 30 allow a person holding mouthguard 10 in their mouth, as shown in FIG. 5, to breathe through airflow channel 14 and connected adjustable valve 18. Apertures 32 are also spaced along inner sidewall 30, including near molar sections 34 of mouthpiece 12, which allows the user to inhale and exhale through the entire arcuate shape of mouthpiece 12. Inhale airflow is depicted and referenced at arrow 115 and exhale airflow is depicted and referenced at arrow 116.

Adjustable airflow-restricting valve 18 is connected to mouthpiece 12 through airflow port 22 which is in fluid communication with airflow channel 14 through aperture 36 in outer sidewall 28 as comparatively depicted and referenced in FIGS. 2 and 3. Comparatively referencing FIGS. 2 and 3 the reader will note that aperture 36 in outer sidewall 28 is aligned with an aperture 32 within inner sidewall 24 to form airflow channel 14. Airflow port 22 (with its surrounding valve body wall structure) extends outwardly from mouthpiece 12 to create lip rest area 38 where the user's lips 20 (FIG. 5) rest during use. In one preferred embodiment, lip rest area 38 extends approximately ½ inch to 1 inch from outer side wall 28, such that mouthguard 10 can comfortably fit behind (underneath) a facemask of an athletic helmet, as shown in FIG. 4. One important consideration in designing the size and shape of valve 18 is balancing the weight of valve 18 in relation to the weight of mouthpiece 12 such that the overall weight of mouthguard 10 is not front-heavy when held in the mouth of a user. Another important consideration in designing the size and shape of valve 18 is making it easily wearable behind athletic facemasks, as previously mentioned. Valve body 40 has annular valve seat 42 in which rotatable valve member 44 may be selectively rotated. As perhaps best be appreciated in FIG. 2, valve member 44 has restricting wall portion 46 and airflow window aperture 48 which can be selectively rotated in front of airflow port 22 to selectively restrict airflow through port 22 and thereby through airflow channel 14 of mouthpiece 12. The adjustable airflow-restricting valve offers various levels of airflow from no (minimal) resistance, to any one of a number of airflow resistance levels, in to and out of the lungs through the adjustable valve. Preferred embodiments restrict both inspiratory and expiratory airflow through a two-way adjustable valve, thus working the lung muscles for both inhalation and exhalation, causing the respiratory system to become more efficient and stronger. However, the scope of the invention is not limited specifically to two-way valves; the valve can easily be interchanged with a one-way valve restriction if preferred, either inspiratory or expiratory, although research indicates both inspiratory and expiratory restriction for best lung conditioning. Valve 18 has rotatable dial valve member 44 which rotates in clockwise and counter clockwise directions to allow maximum flexibility in offering the user no airflow resistance when set to 0, to increasing resistance from level 1 to maximum resistance airflow at level 5. This unit is currently configured for use with or without nose plug or clips, however, the most highly conditioned athletes could use with nose plugs or clips. Users may attach nose plugs to the top of lip shield 16 with string or a strap (not shown) if needed, however most users will not likely use nose plugs.

Mouthpiece 12 should be constructed or molded, preferably, from a firm but flexible FDA approved compounding material such as thermoplastic polyurethane (TPU) or similar, ethylene vinyl acetate (EVA), or other siliconized rubber type materials which absorb and diffuse impact throughout the entire mouthpiece. Adjustable airflow valve 18 should be constructed of medium density thermoplastic or similar material which is shatterproof and somewhat flexible. Device 10 is constructed or, more particularly, molded around the airflow channel to contain a large breathing orifice, in which the preferred shape of orifice is oval in design, but not limited to that particular shape. The orifice originates and follows the curvature of the lip shield and continues inward, surrounded by an airflow port which user's lips contact and rest upon when in use. Additionally, part of the airflow port (22) is a protective lip flange structure (16) which helps to protect the front teeth and gums from the rear side of the lip flange structure as well as support and stabilize the tooth pads (24, 26) as they connect and extend outward from the airflow port. Finally, the thickness of the airflow port should be enough to not significantly restrict airflow in any way when a user's lips create downward pressure.

Lip shield 16 curves convexly around the users mouth and lips protecting the anatomy of the orbicularis oris muscle from direct contact as can be appreciated in FIG. 5. Additionally, the lip shield curves slightly longitudinally to conform to the tooth cylinder of the skull. The preferred shape of the lip shield is generally oval, with curved angles at its left and right outside edges. The lip shield is fairly thin in nature, approximately ⅛" to ¼" thickness, tapering to its ends.

Rotatable dial valve member 44 is snapped into the recessed channels within valve body 40, thus assembled ready for use. Once snapped together valve dial 44 rotates with manual pressure and clicks into desired levels of resistance, or no resistance to airflow at all. The six position level markers shown in the preferred embodiment of FIG. 1 is for illustration purposes only. The actual number of resistance levels incorporated into the device may be infinite as the valve can turn from (near) 0% restriction resistance to 99% restriction resistance of airflow and all amounts in between. For example, one could configure the dial with 100 levels of resistance, one level per percentage point of resistance up to 100% (full closure), at which point the user would breathe only though the nose or from around the mouthguard itself.

For best fit and performance, mouthguard device 10 may be molded with a more firm than flexible material as to not allow tooth pads 24, 26 to contract when bitten down upon so at to not allow the front teeth to contact each other. It is preferable mouthguard device 10 with mouthpiece 12 be sold as a ready-made or non-moldable mouthpiece. However, it is contemplated as being beneficial to allow a moldable, customizable portion which may be overlaid upon the top of a more permanent mouthpiece portion which may allow a more custom fit for users.

In the preferred embodiment of the present invention the entire body portion, lip shield, airflow channel structure and tooth pads are a one-piece molding of an elastomer, such as an F.D.A. approved siliconized rubber or plastic having a durometer in the range of 40-70, with a Shore A hardness.

Adjustable valve 18 of mouthguard device 10 is preferable made of one-piece durable, somewhat flexible, shatterproof plastic or hard siliconized rubber, or similar, that snaps in place into valve seat 42 and is rotated manually for adjustable, two-way airflow resistance.

Mouthguard device 10 is easily assembled and snapped together. The assembled device can be easily cleaned in appropriate antiseptic solutions as so to easily keep oral hygiene to highest standards.

Mouthguard device 10 can be used for a variety of different anaerobic and aerobic applications which improve athletic respiratory and related performance, improving user's respiratory muscular endurance and overall efficiency.

Figure 9:
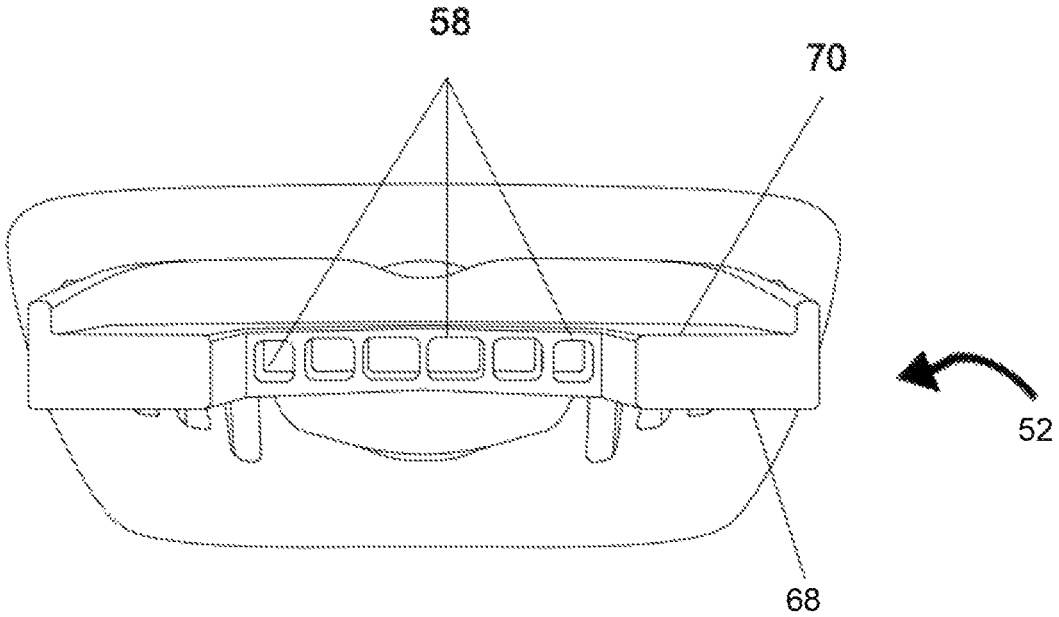
Figure 10:
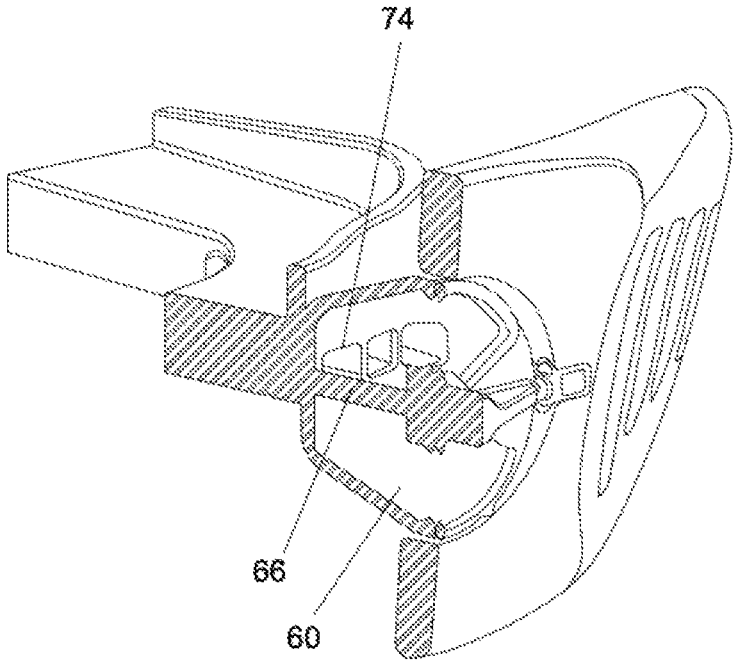
FIG. 10 and FIG. 11 are longitudinal cross-section views of the mouthguard of FIGS. 6-9.
Figure 11:
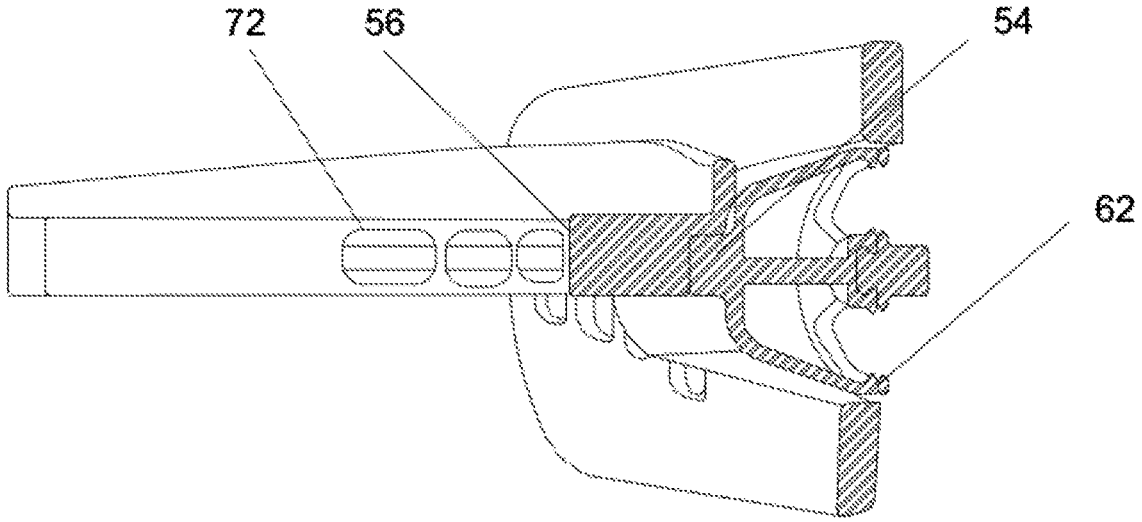
Figure 12:
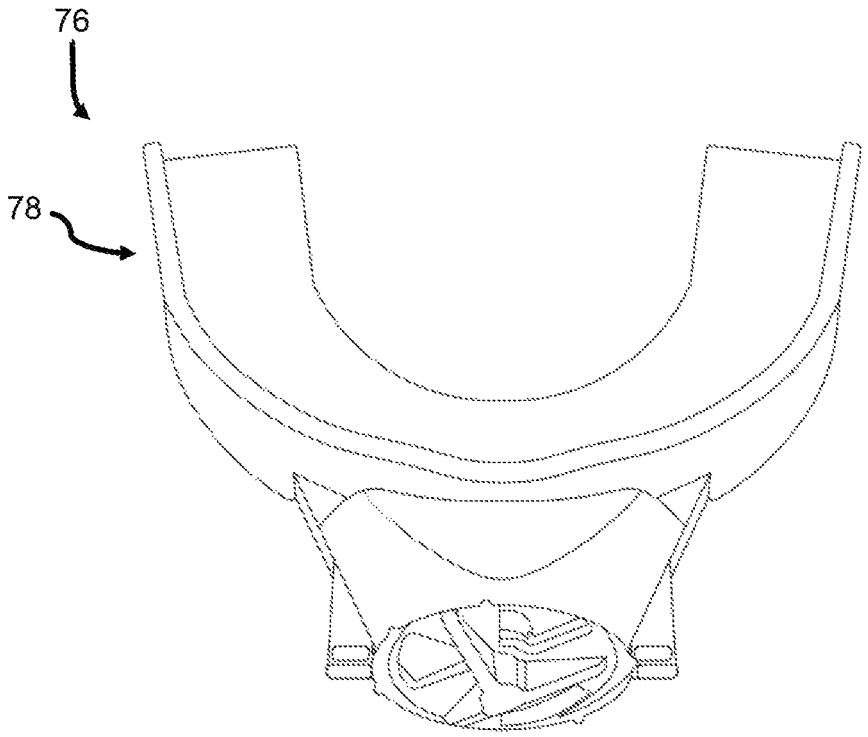
FIG. 12 and FIG. 13 show a third preferred embodiment of an athletic mouthguard with variable airflow-restricting valve according to the invention.
Figure 13:
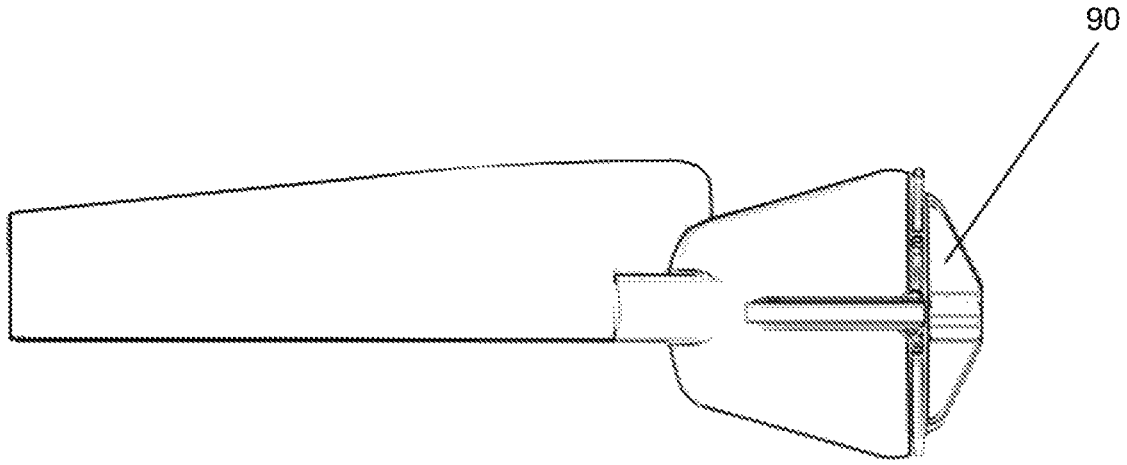
Figure 14:
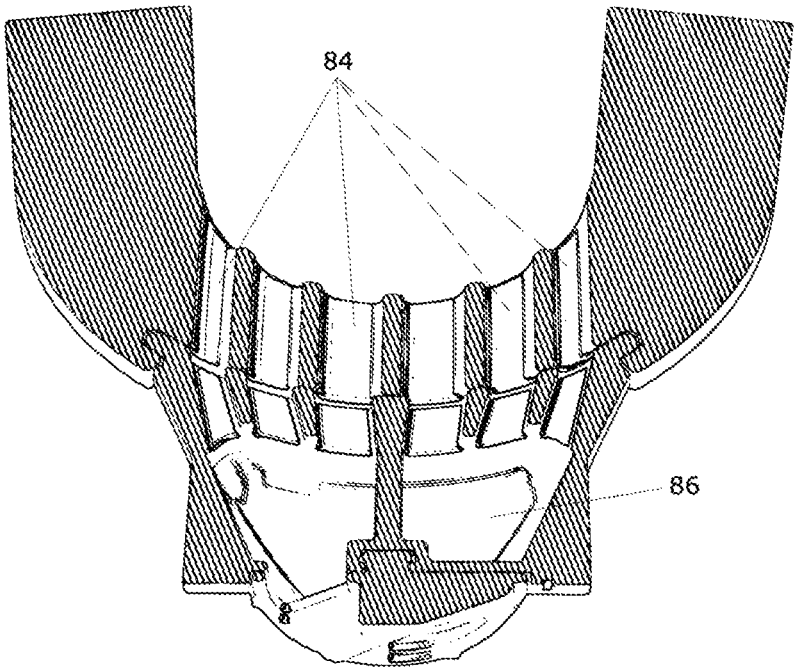
FIG. 14 and FIG. 15 are lateral cross-section views of the mouthguard of FIG. 12.
Figure 15:
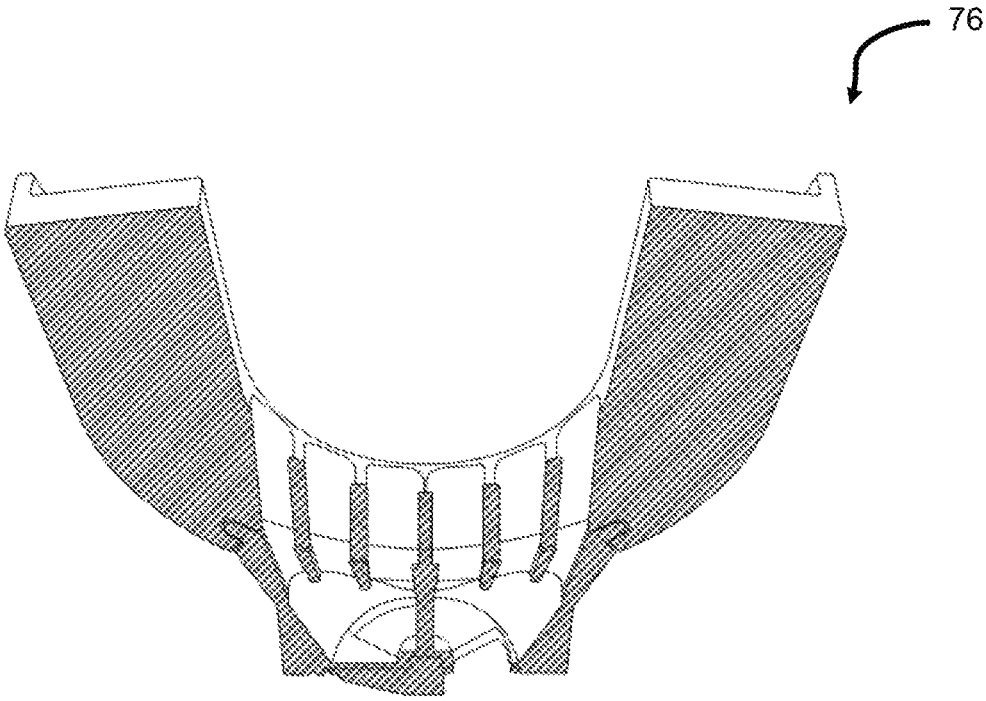

FIGS. 6-12 show a second preferred embodiment of an athletic mouthguard with compact variable airflow-restricting valve 50 according to the invention which can be used by athletes wearing helmets with facemasks. Mouthguard 50 generally includes mouthpiece 52 with outer sidewall 54 (FIG. 11), inner sidewall 56 and airflow channels 58 (FIG. 9). Manifold section 60 (FIG. 10) has valve seat in a centralized aperture 62 (FIG. 11) and rotatable valve member 64 (FIG. 6) seated in valve seat 62. Rotatable valve member 64 is rotatably connected to central valve member post 66 which allows valve member 64 to rotate.

FIG. 9 shows mouthpiece 52 has lower arcuate tooth bed 68 and upper arcuate tooth bed 70, between which airflow channels 58 pass. Each airflow channel 58 has a first end 72 (FIG. 11) opening within inner sidewall 56 and a second end 74 (FIG. 10) opening within outer sidewall 54.

FIGS. 12-17 show a third preferred embodiment of an athletic mouthguard with compact variable airflow-restricting valve 76 according to the invention which can be used by athletes wearing helmets with facemasks. Mouthguard 76 generally includes mouthpiece 78 (FIG. 12), outer sidewall 80 (FIG. 17), inner sidewall 82 (FIG. 16), airflow channels 84 (FIG. 14), manifold section 86, valve seat in centralized aperture 88 (FIG. 16), and rotatable valve member 90 (FIG. 13) seated in valve seat 88.

Figure 16:
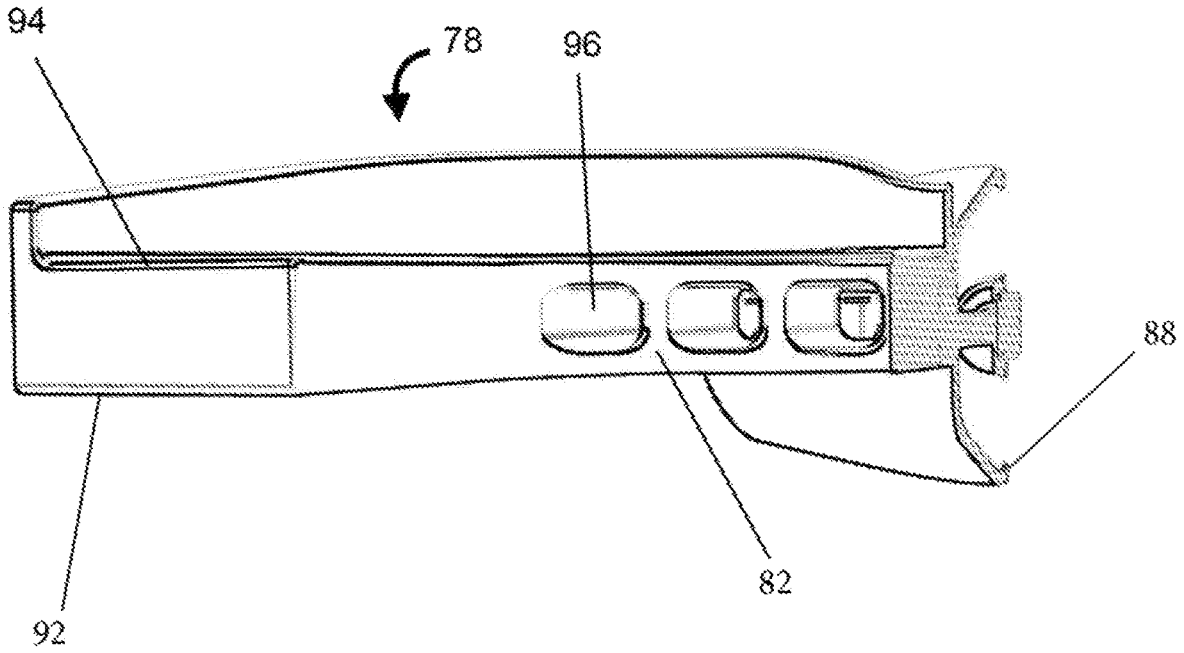
FIG. 16 and FIG. 17 are partial cross-sectional views of the mouthguard of FIGS. 12-13.
Figure 17:
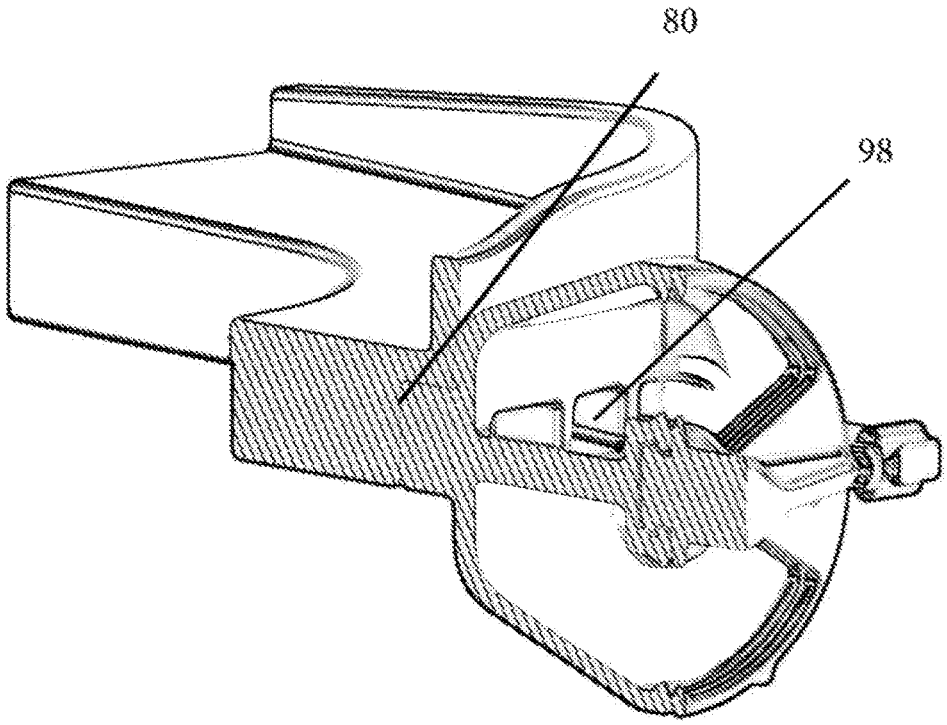
Figure 18:
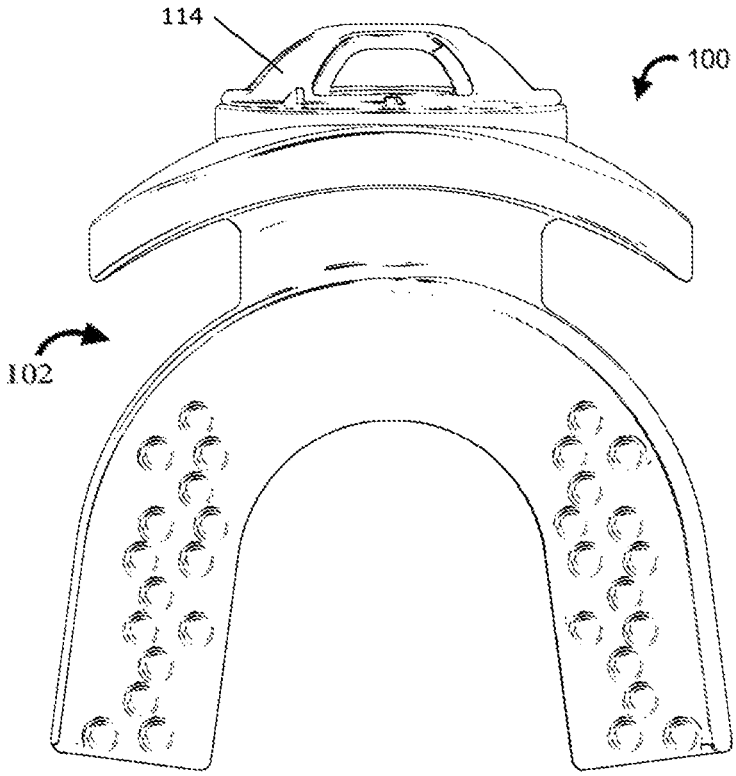
FIG. 18 shows a fourth preferred embodiment of an athletic mouthguard with variable airflow-restricting valve according to the invention.
Figure 19:
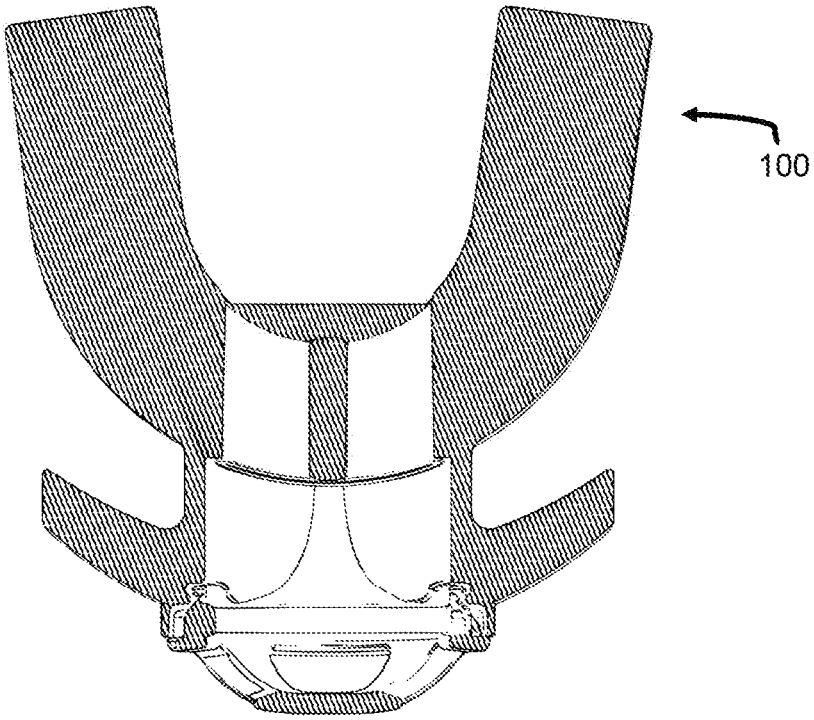
FIG. 19 is lateral cross-section of FIG. 18.
Figure 20:
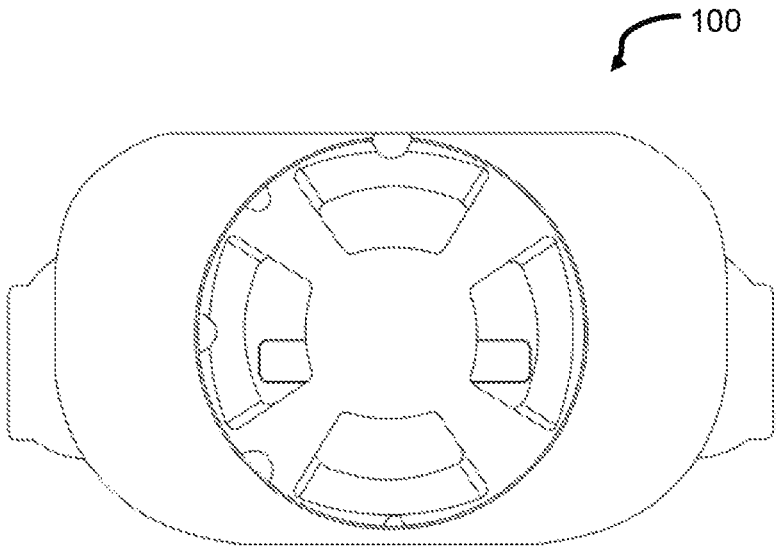
FIG. 20 is a front elevational view of the mouthguard of FIG. 18.
Figure 21:
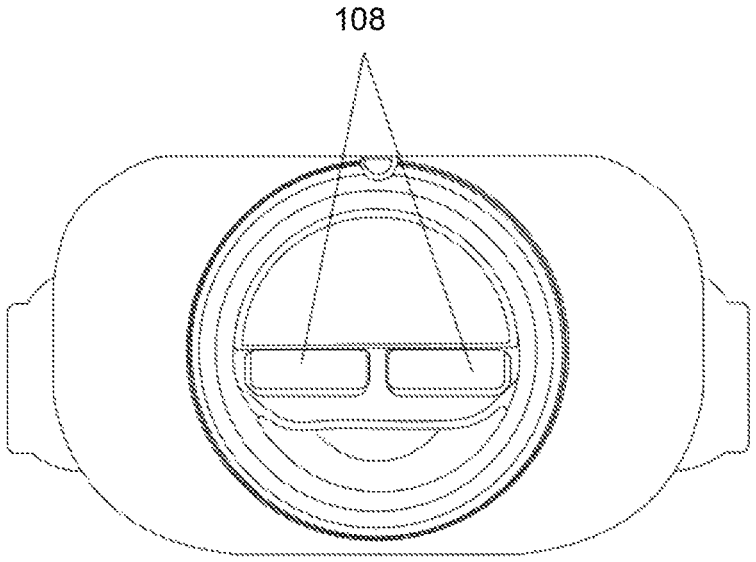
FIG. 21 is the front elevational view of FIG. 20 with the mouthguard's rotatable disc removed.
Figure 22:
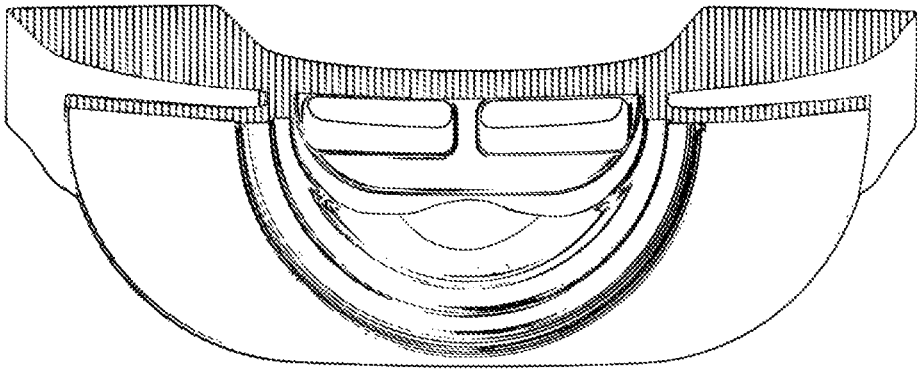
FIG. 22 is a lateral cross-sectional view of FIG. 21.
Figure 23:
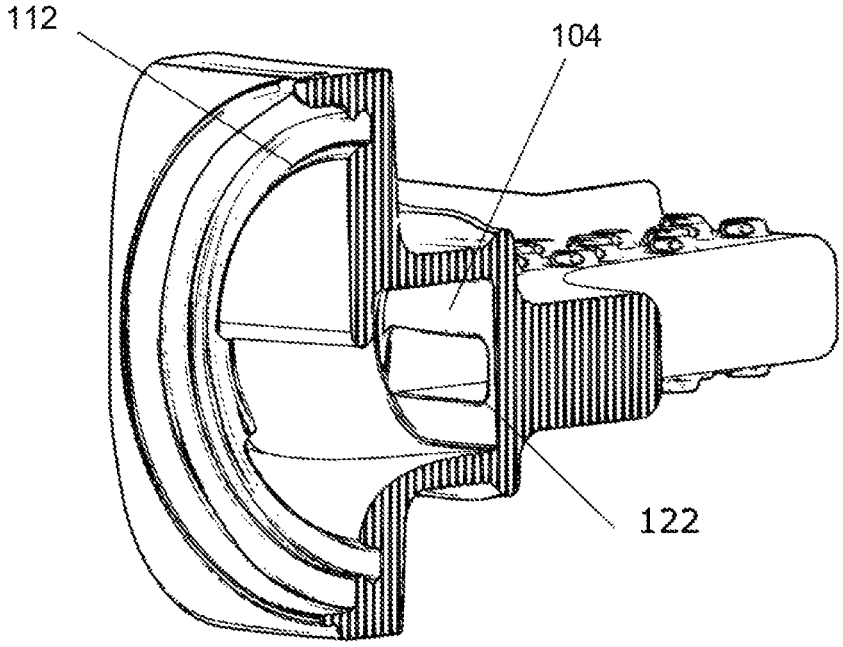
FIG. 23 and FIG. 24 are longitudinal cross-section views of the mouthguard of FIG. 18.

FIG. 16 shows mouthpiece 78 has lower arcuate tooth bed 92 and upper arcuate tooth bed 94, between which airflow channels 84 pass. Each airflow channel 84 has a first end 96 opening within inner wall 82 and a second end 98 (FIG. 17) opening within outer sidewall 80.

FIGS. 18-25 show a fourth preferred embodiment of an athletic mouthguard with compact variable airflow-restricting valve 100 according to the invention which can be used by athletes wearing helmets with facemasks. Mouthguard 100 generally includes mouthpiece 102, outer sidewall 104 (FIG. 23), inner sidewall 106 (FIG. 24), airflow channels 108 (FIG. 21), manifold section 110 (FIG. 24), a valve seat in a centralized aperture 112 (FIG. 23), and a rotatable valve member 114 (FIG. 18) seated in valve seat 112.

Figure 24:
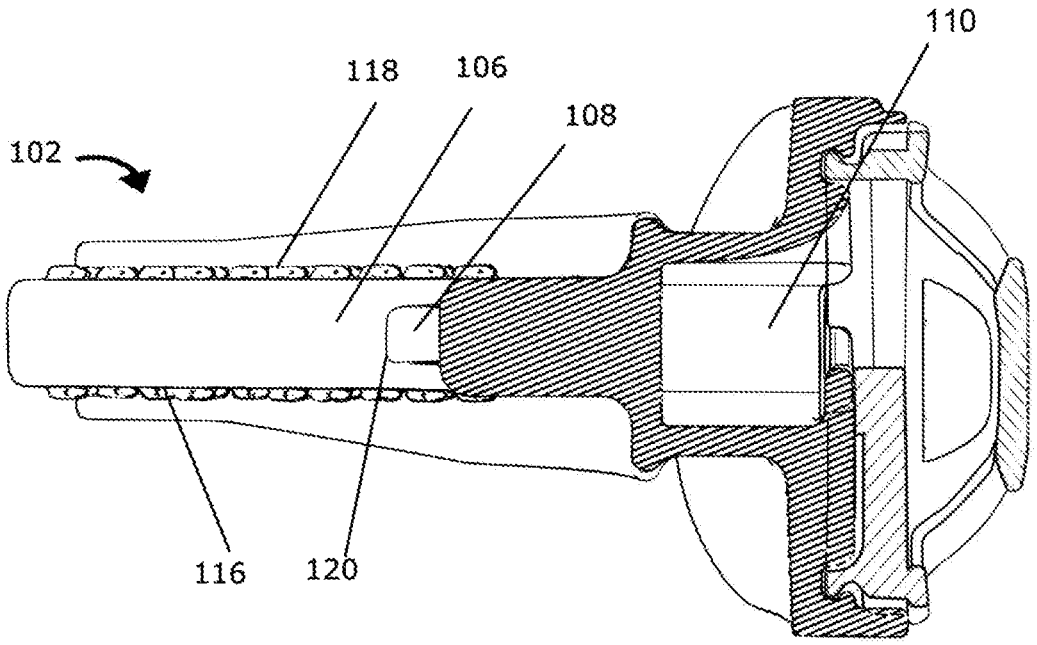
Figure 25:
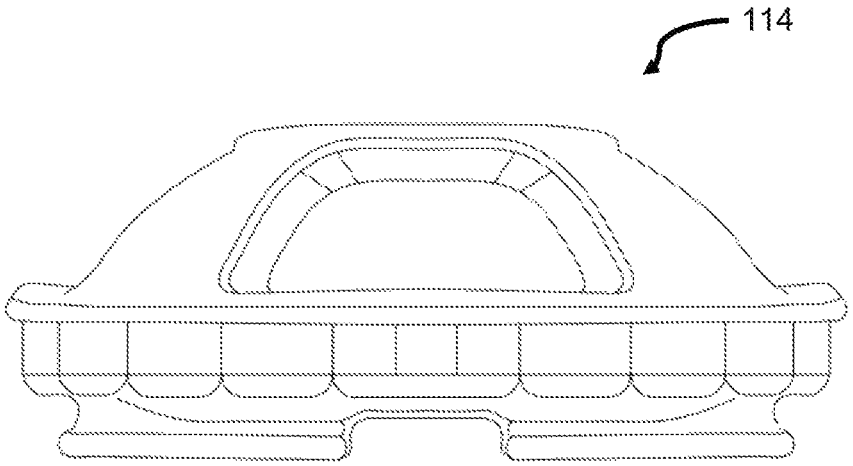
FIG. 25 shows the rotatable disc used in the mouthguard of FIG. 18.
Figure 26:
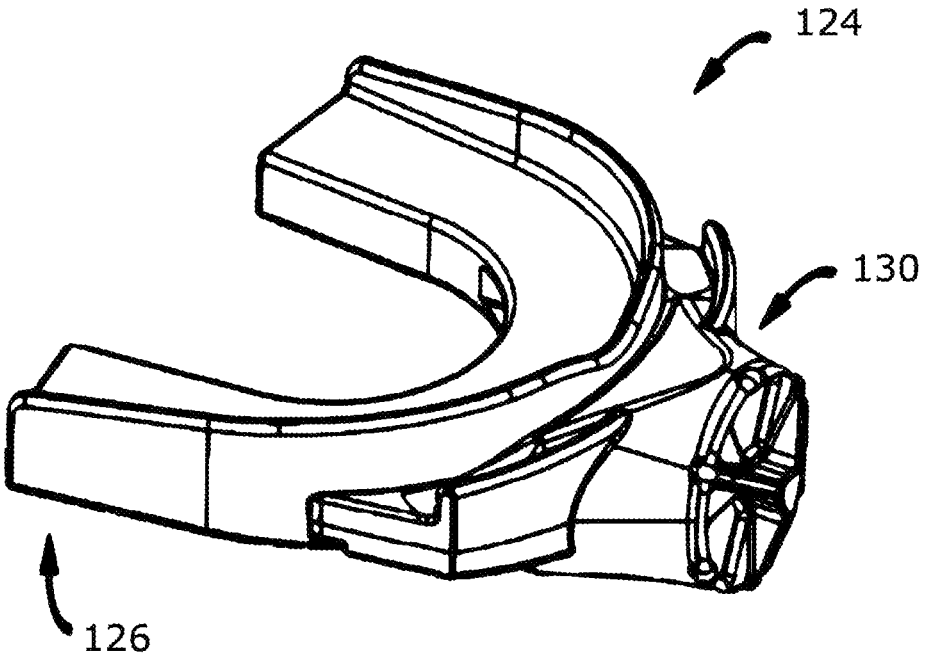
FIG. 26 shows a fifth preferred embodiment of an athletic mouthguard with variable airflow-restricting valve according to the invention.

FIG. 24 shows mouthpiece 102 has lower arcuate tooth bed 116 and upper arcuate tooth bed 118, between which airflow channels 108 pass. Each airflow channel 108 has a first end 120 opening within inner wall 106 and a second end 122 (FIG. 23) opening within outer sidewall 104.

FIGS. 26-29 show a fifth preferred embodiment of an athletic mouthguard with compact variable airflow-restricting valve 124 according to the invention which can be used by athletes wearing helmets with facemasks. Mouthguard 124 generally includes mouthpiece 126 with socket 128 (FIG. 27) which receives three-part airflow-restricting valve 130. Valve 130 generally includes upper valve body portion 132, lower valve body portion 134 and rotatable valve member 136. Valve 130 is shown as being laterally split into upper (132) and lower (134) portions, generally along the mid-line of airflow channels 142. However, it is contemplated valve 130 may also be designed with longitudinally split portions. The design of this particular embodiment is made to facilitate molding mouthpiece 126 and valve 130 out of different kinds of plastic so each of the respective parts may have different attributes to achieve their desired function. For example, mouthpiece 126 may be molded out of a flexible polyurethane like most athletic mouthpieces are currently made of, while valve 130 may be molded out of a more rigid, but shatterproof thermoplastic to make valve 130 more durable and easy to adjust.

Figure 27:
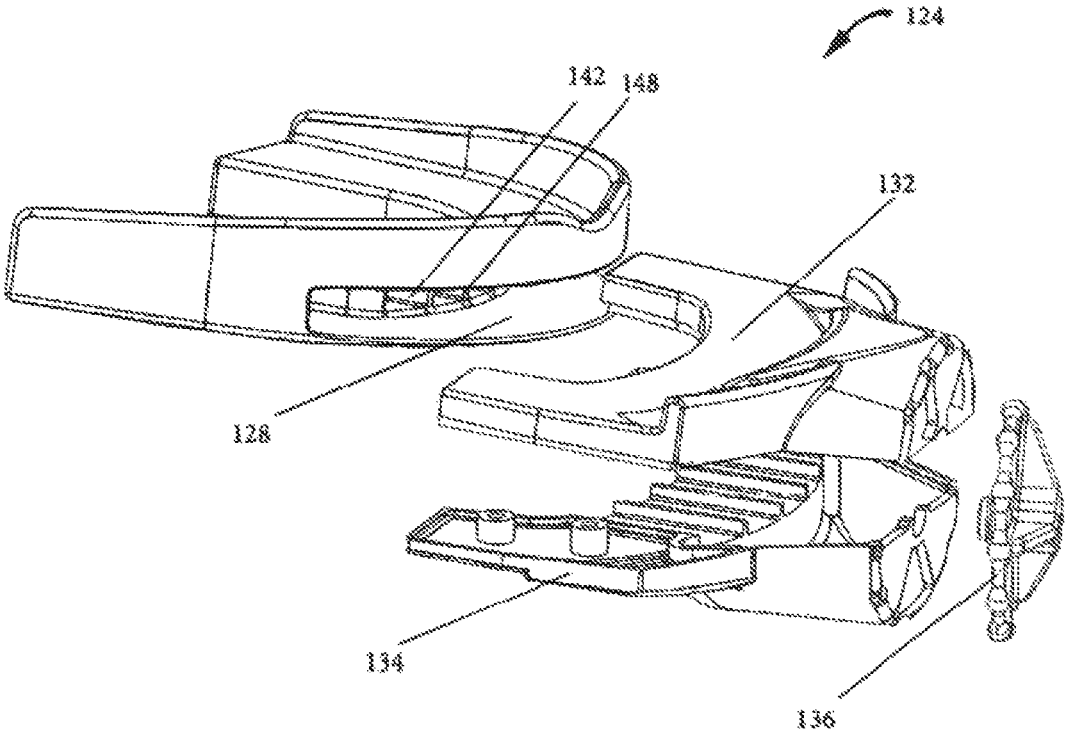
FIG. 27 is an exploded perspective view of the mouthguard of FIG. 26.
Figure 28:
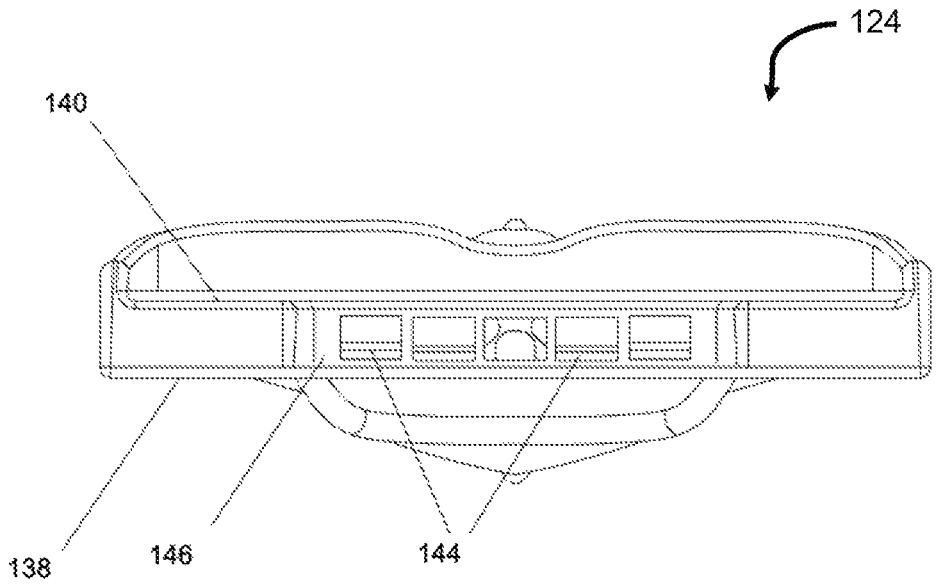
FIG. 28 is a rear elevational view of the mouthguard of FIG. 26.
Figure 29:
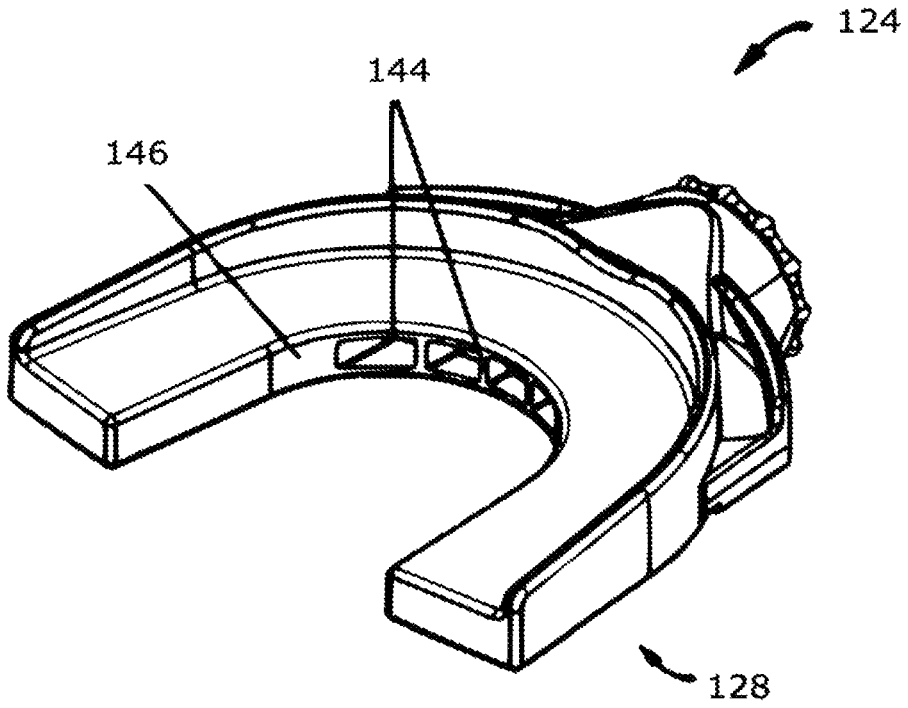
FIG. 29 is a rear perspective view of the mouthguard of FIG. 26.

FIGS. 27-28 show mouthpiece 126 has lower arcuate tooth bed 138 and upper arcuate tooth bed 140, between which airflow channels 142 pass. Each airflow channel 142 has a first end 144 opening with inner wall 146 and a second end 148 opening within socket 128.

Figure 30:
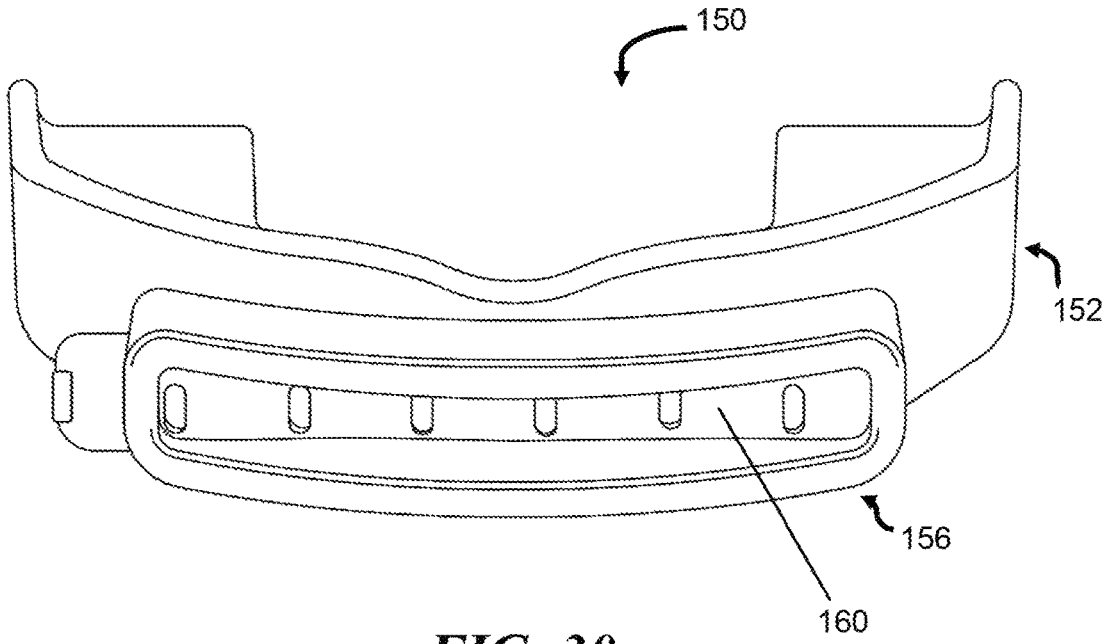
FIG. 30 shows a sixth preferred embodiment of an athletic mouthguard with variable airflow-restricting valve according to the invention.
Figure 31:
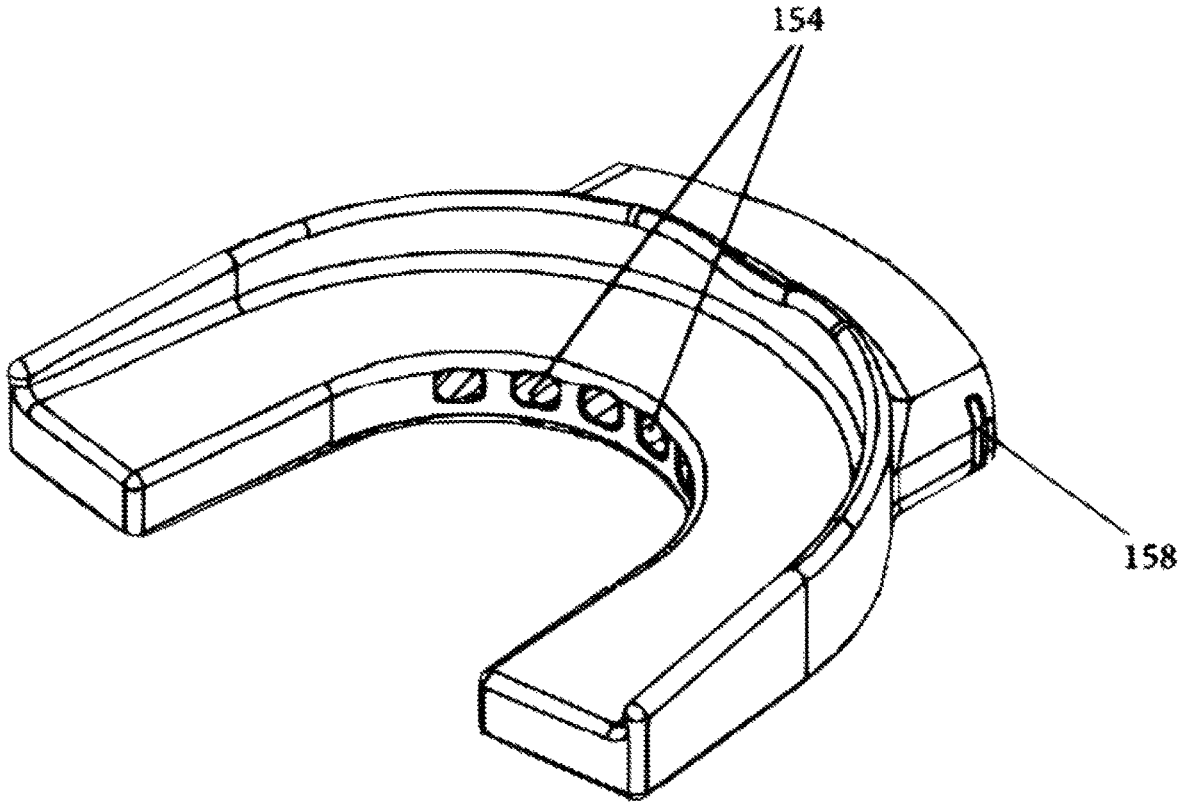
FIG. 31 is a rear perspective view of the mouthguard of FIG. 30.
Figure 32:
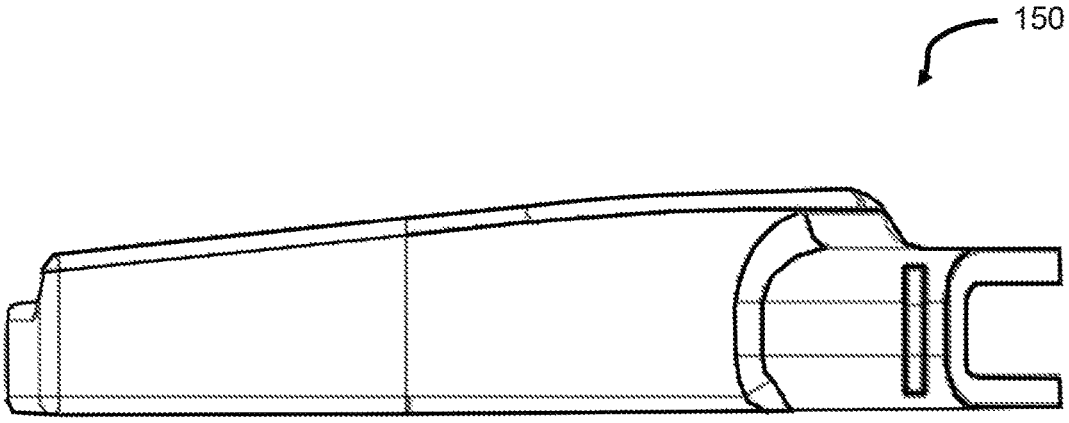
FIG. 32 is a side elevational view of the mouthguard of FIG. 30.
Figure 33:
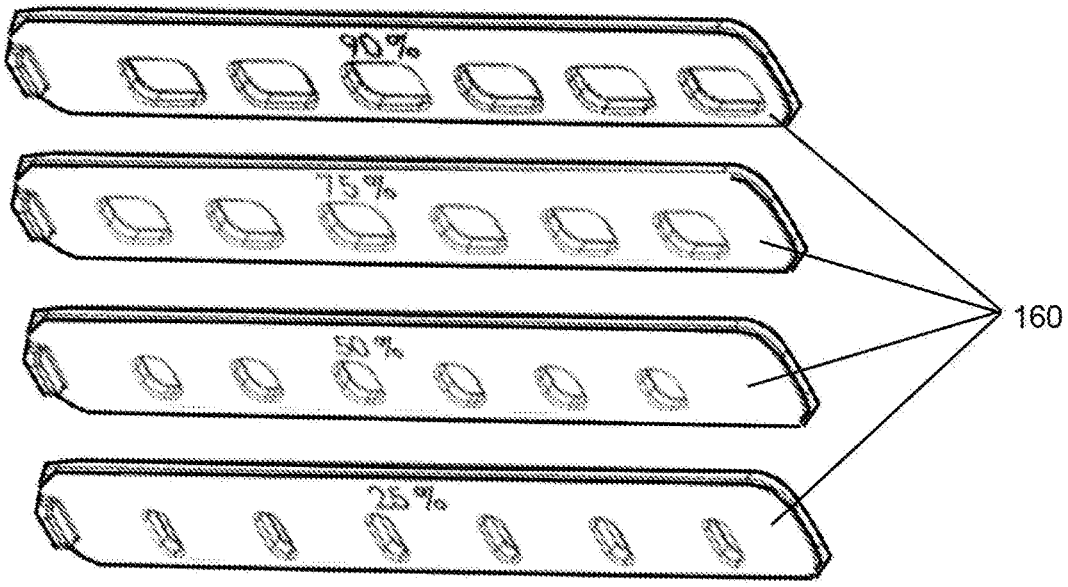
FIG. 33 shows several restricting valve members which may be used in the mouthguard of FIG. 30.

FIGS. 30-32 show a sixth preferred embodiment of an athletic mouthguard with variable airflow-restricting valve 150 according to the invention. Mouthguard 150 generally includes mouthpiece 152 with integrated airflow channels 154 and adjustable airflow-restricting valve 156. Valve 156 has valve seat opening 158 through which valve members 160 slide. FIG. 33 shows valve members 160 of varying levels of restriction which may be used with mouthguard 150. Another contemplated version of this embodiment involves lowering the complexity of its manufacture by molding mouthguard 150 in one-piece construction, where valve member 160 is integrally molded into airflow-restricting valve 156. Several of these one-piece construction mouthguards of varying levels of airflow restriction may be sold together as a color-coded set.

While the invention has been illustrated and described in detail in the drawings and foregoing description, the same is to be considered as illustrative and not restrictive in character, it being understood that only preferred embodiments have been shown and/or described and that all changes and modifications that come within the spirit of the invention are desired to be protected.

What is claimed is:

1. A mouthguard with lung exercising variable airflow-restricting valve, comprising:

a mouthpiece with a lower tooth bed and an upper tooth bed overlying said lower tooth bed;

an outer sidewall connecting said lower and upper tooth beds;

an inner sidewall spaced apart from said outer sidewall and connecting said lower and upper tooth beds;

a channel passing between said lower and upper tooth beds, said channel having a first end open within said inner sidewall and a second end open within said outer sidewall;

a manifold in fluid communication with said channel, and terminating to a centralized aperture;

a valve seat at said centralized aperture; and a rotatable valve member seatable in said valve seat and having an aperture therethrough, the rotatable valve member being rotatably adjustable in clockwise and counter-clockwise directions for adjusting airflow resistance therethrough.

2. The mouthguard of claim 1, further comprising a lip shield extending outwardly from said manifold, and wherein said manifold extends outwardly from said outer sidewall forming a lip engagement area between said lip shield and said outer sidewall.

3. The mouthguard of claim 2, wherein said manifold extends about 1 inch from said outer sidewall.

4. The mouthguard of claim 3, wherein said channel is separated into multiple channels by at least one channel wall therein.

5. The mouthguard of claim 1, further comprising a center post connected to a channel wall of the channel to which said rotatable valve member is rotatably connected.

6. The mouthguard of claim 5, wherein said rotatable valve member is configured for enabling both inspiratory and expiratory equal airflow resistance for balanced lung muscle exercising.

7. The mouthguard of claim 1, wherein said channel is separated into multiple channels by at least one channel wall therein.

8. The mouthguard of claim 1, wherein said manifold is sized and shaped to fit behind an athletic facemask while said mouthguard is worn by a user wearing an athletic helmet having a facemask.

9. The mouthguard of claim 1 wherein the rotatable valve member comprises a restricting wall portion and an airflow window aperture, the restricting wall portion being selectively rotatable in front of said centralized aperture to selectively restrict airflow through said centralized aperture.

10. A mouthguard with lung exercising variable airflow-restricting valve, comprising:

a lower arcuate tooth bed with left and right molar sections;

an upper arcuate tooth bed with left and right molar sections, said upper arcuate tooth bed spaced apart from and overlying said lower arcuate tooth bed;

an outer sidewall connecting said lower and upper arcuate tooth beds;

an inner sidewall connecting said lower and upper arcuate tooth beds and spaced apart from said outer sidewall, defining a channel disposed between and coextensive with said lower and upper arcuate tooth beds;

a plurality of apertures through said inner sidewall which open to said channel and extend inwardly of said left and right molar sections of said lower and upper arcuate tooth beds and;

an aperture through said outer sidewall which opens to said channel;

a valve body with an airflow port in fluid communication with said aperture of said outer sidewall;

an annular valve seat surrounding said airflow port; and a rotatable valve member seatable in said valve seat, having an aperture therethrough, the rotatable valve member being selectively rotatable in clockwise and counter-clockwise directions for selectively increasing and decreasing airflow resistance into and out of the rotatable valve member for working lung muscles during both inhalation and exhalation.

11. The mouthguard of claim 10, further comprising a lip shield extending outwardly from said valve body, wherein said valve body extends outwardly from said outer sidewall to form a lip engagement area between said lip shield and said outer sidewall.

12. The athletic mouthguard of claim 11, wherein said valve body extends about 1 inch from said outer sidewall.

13. The mouthguard of claim 10 wherein said lower tooth bed and said upper tooth bed are configured to receive custom molded overlays therein.

14. The mouthguard of claim 10, wherein said valve body is sized and shaped to fit behind an athletic facemask while said mouthguard is worn by a user wearing an athletic helmet having a facemask.

15. The mouthguard of claim 10 wherein the rotatable valve member comprises a restricting wall portion and an airflow window aperture, the restricting wall portion being selectively rotatable in front of said airflow port to selectively restrict airflow through said airflow port.

16. A mouthguard with lung exercising variable airflow-restricting valve, comprising:

a mouthpiece with a lower tooth bed and an upper tooth bed overlying said lower tooth bed;

an outer sidewall connecting said lower and upper tooth beds;

an inner sidewall spaced apart from said outer sidewall and connecting said lower and upper tooth beds;

a channel passing between said lower and upper tooth beds, having a first end open within said inner sidewall;

a manifold in fluid communication with said channel and terminating to a centralized aperture;

a valve seat at said centralized aperture; and a valve member seatable within said valve seat and having an aperture therethrough, the valve member being manually adjustable for increasing and decreasing airflow resistance therethrough.

17. The mouthguard of claim 16, wherein:

said mouthpiece has a socket opening within said outer sidewall, the channel having a second end open within said socket opening; and said manifold is a separable structure from said mouthpiece, wherein said manifold is insertable within said socket opening.

18. The mouthguard of claim 17, wherein said channel is separated into multiple channels by at least one channel wall therein.

19. The mouthguard of claim 16, wherein:

said valve seat comprises a slot opening within a sidewall of said manifold; and said valve member comprises a restrictor plate slidable within said valve seat.

20. The mouthguard of claim 19, wherein said channel is separated into multiple channels by at least one channel wall therein.

* * * * *